US012185817B1

(12) United States Patent
Briggs-Hopson

(10) Patent No.: US 12,185,817 B1
(45) Date of Patent: Jan. 7, 2025

(54) LIPSTICK BARREL

(71) Applicant: Frankie L. Briggs-Hopson, Brighton, CO (US)

(72) Inventor: Frankie L. Briggs-Hopson, Brighton, CO (US)

( * ) Notice: Subject to any disclaimer, the term of this patent is extended or adjusted under 35 U.S.C. 154(b) by 0 days.

(21) Appl. No.: 17/808,455

(22) Filed: Jun. 23, 2022

(51) Int. Cl.
*A45D 40/26* (2006.01)
*A45D 40/00* (2006.01)

(52) U.S. Cl.
CPC .... *A45D 40/265* (2013.01); *A45D 2040/0006* (2013.01); *A45D 2040/0025* (2013.01)

(58) Field of Classification Search
CPC ..... A45D 40/265; A45D 2040/0025; A45D 40/00; A45D 2040/0006; A45D 2040/0012; A45D 34/045
USPC ..... 401/195, 52, 98, 123–125
See application file for complete search history.

(56) References Cited

U.S. PATENT DOCUMENTS

D144,145 S * 3/1946 Silson ..... D28/77
2,452,131 A * 10/1948 Kruck ..... A45D 40/18 401/19
2,552,714 A * 5/1951 Gardiner ..... A45D 40/18 401/19
2,590,329 A * 3/1952 Kromray ..... A45D 40/18 401/18
5,178,478 A * 1/1993 Ryder ..... A45D 40/18 401/195
7,007,700 B2 * 3/2006 Burroughs ..... A45D 40/18 132/297
8,221,014 B1 * 7/2012 Houston ..... A46B 11/00 132/297
2015/0189973 A1 * 7/2015 Swain ..... A45D 40/262 401/18

* cited by examiner

*Primary Examiner* — David J Walczak

(57) ABSTRACT

A small cosmetic container with lid and bottom sized enough to hold a tube of lipstick and has an attached tool adapter for applying left-over lipstick from the tube of lipstick. Small items like lip balms and lip glosses can also be substituted and carried therein it's designed compact, lightweight and most convenient carrying while highlighting and touching up on beauty maintenance.

1 Claim, 1 Drawing Sheet

LIPSTICK BARREL

SUMMARY OF INVENTION

From a first aspect the invention provides a safe storage place for a lipstick tube that's partially used which will remain in the bottom of tube and go to waste if not improvised by using i.e., fingertip, que tip, or something suitable for engaging in the contents from the lipstick tube to avoid having to dispose of it. The invention has the applicator tool safely stored and permanently attached to smoothly and conveniently engage into partially used lipstick tube once the contents are below the rim of the lipstick tube. The lid/top safely and conveniently, (with the tool adapter attached) it's used to apply contents of lipstick from lipstick tube. The tool adapter is fit down alongside the inside of the invention for secure closure.

From a second aspect, by providing an applicator tool that is stored within the top/lid of the invention and a lipstick tube containing left-over remains of lipstick conveniently stored, wherein the applicator tool is sized so that it fit inside the invention lid/top such that the applicator tool is securely attached. As the applicator tool securely attaches, there is no chance of it becoming lost within say a handbag or cosmetic bag being used to carry. By providing an attached applicator tool within the lid/top of the invention, for applying left-over, the present invention allows the applicator tool be conveniently stored and transported for whenever the application of lipstick is required.

BRIEF DESCRIPTION OF DRAWINGS

The purpose of this illustration is to identify the principles of the invention to be more fully understood.

DETAILED DESCRIPTION OF INVENTION

Figure 1:
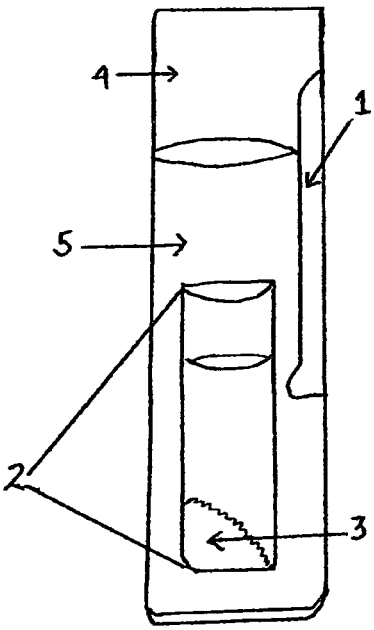
FIG. 1 shows full view of invention while closed with applicator tool attached to the inside of lid/top and a lipstick tube containing remains of left over matter each closed inside the present invention.

FIG. 1. Illustration of the designed drawings invention of Lipstick Barrel, to facilitate 2 the lipstick tube placed inside 5 the base of the invention with 3 left over lipstick (matter) ready for use thereby in the lipstick tube 2 when accessed as lid 4 and base 5 are separated.

As shown FIG. 1, the applicator tool 1 is sized and shaped to fit inside lid 4 for accessing remaining lipstick content from lipstick tube 2, stored inside present invention base 5 along with applicator tool 1 attached inside upper lid 4 of present invention without any interference as it is attached to lid 4 along inside where stored and kept along with lipstick tube 2 when present invention is closed or not being used.

Figure 2:
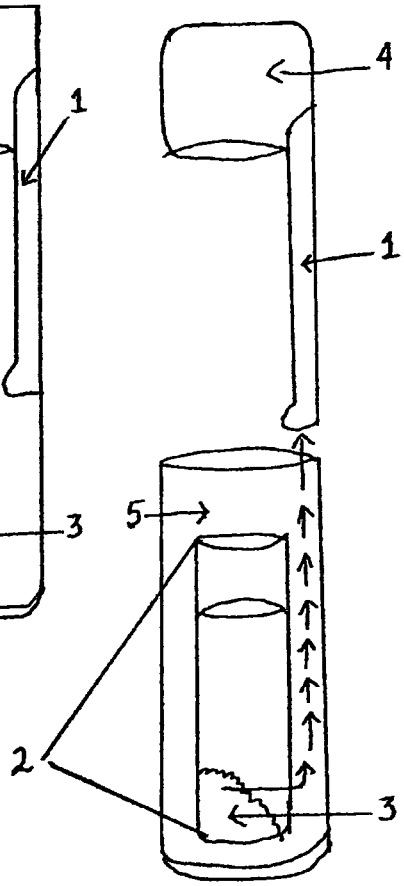
FIG. 2 shows the invention lid/top separated from bottom the adapter tool is attached to lid/top the lipstick tube with remaining content stored inside bottom of present invention.

As shown FIG. 2, when it is desired to apply lipstick, the lid 4, is opened to access the attached applicator tool 1, to engage into lipstick tube 2 for applying. Likely that the lipstick tube will need be removed, in such that it can be engaged in with the applicator tool 1 for retrieval of 3 lipstick matter for applying.

Figure 3:
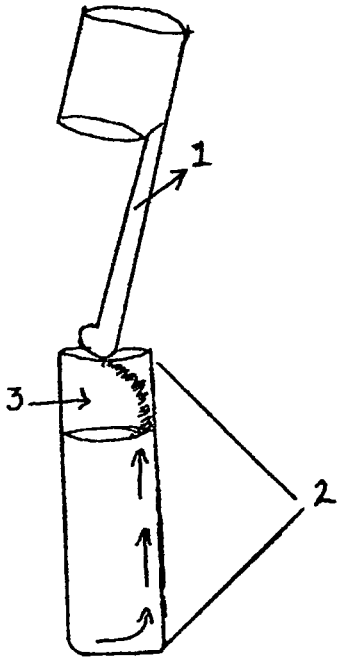
FIG. 3 shows lipstick tube in whole removed from present invention and is accessible for applicator tool to engage for applying. Lipstick tube is enclosed inside the invention for carrying and storing safely.

As shown FIG. 3, the lid 4 of present invention is the handle of the applicator tool 1, that engages in the lipstick tube 2 whereas; the remaining content is raised within the lipstick tube being twisted from bottom of 2 lipstick tube making it easily accessible for the applicator tool 1 to engage with remaining content 3 for applying, yet because the 1 applicator tool can extend down into the 2 lipstick tube it may not be necessary to twist the bottom of 2 lipstick tube to rise 3 the matter to top, a lid for lipstick tube 2 may not be necessary making it easier or more quickly accessible to apply matter on the go

I claim:

1. A combination cosmetic tube dispenser and container comprising:

a container base having a closed bottom, an open top and a sidewall connecting the closed bottom and the open top;

a cosmetic dispensing tube having a cosmetic therein, an outer sidewall surface, a lower end, an upper end and a mechanism for enabling the cosmetic to be projected from the upper end of the cosmetic dispensing tube wherein the cosmetic dispensing tube is positioned within the container base such that the lower end of the cosmetic dispensing tube is positioned on the closed bottom of the container base;

a container lid for coving the open top of the container base; and an applicator tool secured to and depending from an inner side surface of the container lid;

wherein when the container lid is attached to the open top of the container base to thereby close the open top, the applicator tool is positioned within the container base and between an inner side surface of the container base sidewall and the outer side wall surface of the cosmetic dispensing tool such that when a user removes the container lid from the container base, the attached depending applicator tool may be used to reach a lower inner portion of the cosmetic dispensing tube to enable some of the cosmetic remaining in the cosmetic dispensing tube to be applied onto an end of the application tool and then applied to the user by the application tool.

* * * * *